US005202603A

United States Patent [19]

Sugawara et al.

[11] Patent Number: 5,202,603

[45] Date of Patent: Apr. 13, 1993

[54] IN-LINE ELECTRON GUN FOR A COLORED CATHODE RAY

[75] Inventors: Shigeru Sugawara, Saitama; Shinpei Koshigoe, Fukaya, both of Japan

[73] Assignee: Kabushiki Kaisha Toshiba, Kawasaki, Japan

[21] Appl. No.: 642,687

[22] Filed: Jan. 17, 1991

[30] Foreign Application Priority Data

Jan. 18, 1990 [JP] Japan ..... 2-7159
Mar. 20, 1990 [JP] Japan ..... 2-68236

[51] Int. Cl.[5] ..... H01J 29/62

[52] U.S. Cl. ..... 313/414; 313/412; 313/413; 313/428; 313/432; 313/439

[58] Field of Search ..... 313/412, 413, 414, 428, 313/432, 439; 315/382

[56] References Cited

U.S. PATENT DOCUMENTS 4,443,736 4/1984 Chen ..... 313/414
4,528,476 7/1985 Alig ..... 313/412
4,668,892 5/1987 Peels ..... 313/414
4,763,047 8/1988 Watanabe et al. ..... 315/382
4,851,741 7/1989 Shirai et al. .

FOREIGN PATENT DOCUMENTS 3839389 6/1989 Fed. Rep. of Germany .
51-45936 12/1976 Japan .
52-32714 8/1977 Japan .
53-38076 10/1978 Japan .
55-37798 3/1980 Japan .
60-218744 11/1985 Japan .
64-42109 2/1989 Japan .
2-72546 3/1990 Japan .

*Primary Examiner*—Donald J. Yusko
*Assistant Examiner*—Ashok Patel
*Attorney, Agent, or Firm*—Cushman, Darby & Cushman

[57] ABSTRACT

A color cathode ray tube apparatus is provided with an electron gun assembly which emits three electron beams and focuses and converges the electron beam onto a phosphor screen. In the gun assembly, the electron beams generated from cathodes are accelerated and controlled by first and second grids and pass through third, fourth and fifth grids. The third and fourth grids have single rectangular apertures common to the three electron beams, respectively, which are faced to each other and have different heights and widths. Each of the fourth and fifth grids have individual apertures which allow the corresponding electron beams to pass therethrough, respectively. The third and fifth grids is maintained at fixed potentials and a potential of the fourth grid is adjusted. Thus, individual focusing and convergence electron lenses are formed between the fourth and fifth grids. A single and common asymmetrical electron lens is formed between the third and fourth grids, when a potential difference between the third and fourth grids is produced. A misconvergence of three electron beams produced due to the adjustment of the individual electron lenses is corrected by the common asymmetrical electron lens in such a manner that the side electron beams are deflected in accordance with the potential difference.

10 Claims, 17 Drawing Sheets

IN-LINE ELECTRON GUN FOR A COLORED CATHODE RAY

BACKGROUND OF THE INVENTION

1. Field of the Invention

The present invention relates to a color cathode ray tube and, more particularly, to a color cathode ray tube apparatus having an in-line type electron gun assembly which can compensate for static misconvergence of three electron beams, caused by fluctuations in focus of the electron beams.

2. Description of the Related Art

An in-line type electron gun assembly in a conventional color cathode ray tube apparatus as shown in FIG. 1 comprises cathodes 2 respectively incorporating heaters 1, and the following grids, each of which is integrally formed: a first grid 3, a second grid 4, a third grid 5, and a forth grid 6. The third grid 5 is constituted by a cylindrical member having a bottom, which is integrally formed by a mechanical means. Apertures 5G, 5B, and 5R are formed in the bottom of the cylindrical member such that the centers of the apertures respectively coincide with a gun axis ZG of the center electron gun and the gun axes ZB and ZR of the side electron guns. Similarly, the forth grid 6 is constituted by a cylindrical member having a bottom, which is integrally formed by a mechanical means. Apertures 6G, 6B, and 6R are formed in the bottom of the cylindrical member such that the center of the aperture 6G coincides with the gun axis ZG, and the centers of the apertures 6B and 6R are respectively eccentric from the gun axes ZB and ZR. A main electron lens L110 is formed between the third grid 5 and the forth grid 6.

According to such an electron gun assembly, as disclosed in Published Examined Japanese Patent Application No. 52-32714, in the center electron gun, since the centers of the apertures 5G and 6G coincide with the gun axis ZG, a center electron beam 9G propagates straight ahead to a phosphor screen (not shown). In contrast to this, in the side electron guns, each electric field is formed to be asymmetrical about a corresponding one of the gun axes ZB and ZR, and side electron gun beams 9B and 9R passing through these electric fields are bent toward the center electron beam 9G. As a result, these three electron beams 9B, 9G, and 9R are caused to converge on the phosphor screen. As disclosed in Published Examined Japanese patent Application No. 53-38076, electrodes having inclined apertures are used to form asymmetrical electric fields.

In an electron gun assembly, the structure of each electrode is mechanically simple, and the relative positions of the electron lenses of the three electron guns can be accurately determined. Therefore, an electron gun assembly is advantageous in terms of cost and precision. However, there is room for further improvement in such an electron gun assembly. That is, a feature to be improved is associated with eccentrically formed or inclined apertures which are used to converge three electron beams at a predetermined position. The deflection amount of an electron beam deflected by an asymmetrical electron lens formed by such an eccentrically formed or inclined aperture is approximately proportional to the eccentricity or inclination of the aperture and the difference in potential between electrodes which form the electron lens. More specifically, the deflection angle (amount) of a beam deflected by an asymmetrical electron lens is approximately given by the following equation:

$$\theta = k \cdot p \cdot q \quad (1)$$

where $\theta$ is the deflection angle, k is a constant, p is a value obtained by normalizing an electron lens diameter with an eccentricity amount, and g is the voltage ratio of the electron lens.

If, therefore, a voltage is inaccurately applied between the electrodes which form the electron lens, the deflection angle $\theta$ is changed. As a result, static convergence of a color receiver set with no deflection magnetic field being applied is deviated. For example, in an electron gun using a bipotential type electron lens (Bi Potential Focus: to be referred to as a BPF hereinafter), a high acceleration voltage of 25 to 32 kV is applied to the forth grid, and an intermediate voltage set to be 25 to 35% of a convergence voltage is applied to the third grid. However, a voltage to be actually applied includes an error of ±1% of the intermediate voltage due to assembly errors of the associated components. In consideration of convergence, this error is too large to be neglected.

Especially in a recent color cathode ray tube apparatus, final adjustment of a cathode ray tube is performed before it is mounted in a receiver set. For example, Published Examined Japanese Patent Application No. 51-45936 discloses a preset type cathode ray tube, in which three axes, i.e., the tube axis, the axis of an electron gun axis, and the axis of a deflection device are matched with each other by adjusting the field intensity of a permanent magnet magnetized to a plurality of poles and mounted on the outer surface of the neck of a vacuum envelope of the cathode ray so that no adjustment is required after the cathode ray tube is mounted in the receiver set. In a cathode ray tube of this type, as described above, especially when the difference in potential between the electrodes which form an electron lens requires accuracy, if operation conditions of each electron gun, especially a voltage to be applied to the third grid 5, are inaccurately set in adjustment of the receiver set, the electron gun assembly must be adjusted again after it is mounted in the receiver set. This leads to a deterioration in operation efficiency.

Several means for solving such a problem associated with a change in focusing electric field have been proposed. For example, as shown in FIG. 2, Published Examined Japanese Patent Application No. 1-42109 discloses a structure in which first electron lenses are formed between a third grid 5, a forth grid 6, and a fifth grid 7, and second electron lenses are formed between the fifth grid 7 and a sixth grid 8 in such a manner that apertures which oppose each other are eccentrically formed to make the first and second electron lenses asymmetrical, through which side beams pass to be deflected to converge at a predetermined position. In such a structure, however, a side electron beam deflected by the first electron lens propagates along the tube axis side of the second electron lens and hence is subjected to the influence of a coma through the second electron lens. As a result, a halo may be produced in the side electron beam in a lateral direction.

Published Unexamined Japanese Patent Application No. 55-37798 discloses a structure in which an electron gun constituted by asymmetrical first and second electron lenses L110 and L120 is designed such that a side electron beam deflected by the first electron lens L110 is incident on the second electron lens L120 while it is substantially inclined to its center, and apertures are eccentrically formed in opposite electrode which form the second electron lens L120. In this structure, however, the structure of each electrode is complicated, and the number of types of electrodes is increased. Therefore, it is very difficult to assemble the electrodes of each electron gun with high precision. This may decrease the resolution.

In addition, Published Unexamined Japanese Patent Application No. 1-42109 or 55-37798 discloses an arrangement in which first and second electron lenses L110 and L120 serve to not only deflect a side electron beam in the in-line direction but also focus it in a direction perpendicular to the in-line direction. FIG. 3 illustrates a positional relationship between an electron lens system and object points in this arrangement. When the first electron lenses L110 for correcting convergence are neglected, electron beams emitted from virtual object points VP located on the respective axes are focused to a predetermined position by the second electron lenses L120. In practice, however, since the first electron lenses L110 have focusing effects, the virtual object points VP are formed before and after predetermined positions. Especially, since each first electron lens L110 is an asymmetrical electron lens, an electron beam incident on a corresponding second electron lens L120 has an astigmatism. Since an object point viewed from each second electron lens L120 is distorted and deteriorated, a spot size on a phosphor screen is increased, resulting in a decrease in resolution.

SUMMARY OF THE INVENTION

It is an object of the present invention to provide a color cathode ray tube apparatus which can suppress a substantial change in static convergence, of a plurality of electron beams, caused by fluctuations in focus of the electron beams emitted from an in line type electron gun assembly and has high-resolution electron guns free from changes in spot size at a predetermined position on a phosphor screen.

In order to achieve the above object, means for compensating for misconvergence of three electron beams is arranged while the focusing properties of a main electron lens are maintained.

According to the present invention, there is provided a cathode ray tube comprising:

generating means for generating, accelerating, and controlling first, second, and third electron beams in an in-line arrangement;

emitting means for emitting light rays when the first, second, and third electron beams are landed thereon;

first electron lenses, having a predetermined focusing lens power, for respectively focusing the first, second, and third electron beams and causing the first, second, and third electron beams to converge on the emitting means; and an asymmetrical second electron lens common to the first, second, and third electron beams, arranged between the first electron lenses and the generating means, and formed when the focusing lens power fluctuates, for deflecting the first and third electron beams in accordance with the fluctuation, the first, second, and third electron beams being caused to converge on the emitting means upon deflection of the first and third electron beams.

In addition, according to the present invention, there is provided a cathode ray tube comprising:

generating means for generating, accelerating, and controlling first, second, and third electron beams in an in-line arrangement;

emitting means for emitting light rays when the first, second, and third electron beams are landed thereon;

first, second, and third electrodes, arranged between the emitting means and the generating means, for allowing the first, second, and third electron beams to pass therethrough, the first and third electrodes being respectively maintained at first and third fixed potentials, and the second electrode being permitted to receive a slightly fluctuating potential;

first electron lenses, formed between the second and third electrodes, for respectively focusing the first, second, and third electron beams and causing the first, second, and third electron beams to converge on the emitting means; and an asymmetrical second electron lens common to the first, second, and third electron beams, formed between the first and second electrodes, for deflecting the first and third electron beams in accordance with a fluctuating potential, the first, second, and third electron beams being caused to converge on the emitting means.

Furthermore, according to the present invention, there is provided a cathode ray tube comprising:

generating means for generating, accelerating, and controlling first, second, and third electron beams in an in-line arrangement;

emitting means for emitting light rays when the first, second, and third electron beams are landed thereon; and first, second, and third electrodes arranged between the emitting means and the generating means, the first electrode having a first common aperture for allowing the first, second, and third electron beams to pass therethrough, the second electrode having a second common aperture, arranged to oppose the first common aperture, for allowing the first, second, and third electron beams to pass therethrough, and third apertures for respectively allowing the first, second, and third electron beams to pass therethrough, and the third electrodes having forth apertures, respectively arranged to oppose the third apertures, for respectively allowing the first, second, and third electron beams to pass therethrough, wherein the first aperture has a first width along the in-line arrangement, and the second aperture has a second width larger than the first width along the in-line arrangement.

Moreover, according to the present invention, there is provided a cathode ray tube comprising:

generating means for generating, accelerating, and controlling first, second, and third electron beams in an in-line arrangement;

emitting means for emitting light rays when the first, second, and third electron beams are landed thereon; and first, second, and third electrodes arranged between the emitting means and the generating means, the first electrode having a first common aperture for allowing the first, second, and third electron beams to pass therethrough, the second electrode having a second common aperture, arranged to oppose the first common aperture, for allowing the first, second, and third electron beams to pass therethrough, and third apertures for respectively allowing the first, second, and third electron beams to pass therethrough, the third electrodes having forth apertures, respectively arranged to oppose the third apertures, for respectively allowing the first, second, and third electron beams to pass therethrough, the first aperture having a first width along the in-line arrangement, and the second aperture having a second width larger than the first width along the in-line arrangement; and a pair of plate members each extending from the second electrode into the first aperture of the firs electrode and having a third width smaller than the first width.

As described above, according to the present invention, the main electron lens system of the in-line type electron gun assembly of the color cathode ray tube is divided into first and second electron lenses so as to allow the second electron lens to have a function for compensating for misconvergence of the first electron lens. More specifically, the second electron lens is constituted by the asymmetrical lens which is operated only when a potential difference is generated between the electrodes constituting the electron lens. With this arrangement, of a plurality of electron beams, side electron beams are deflected in the in-line direction to compensate for misconvergence of electron beams of the first electron lens. In addition, by increasing the size of the asymmetrical lens, the focusing and diverging lens effects on each electron beam are reduced, while a lens effect enough to deflect side electron beams in the in-line direction is ensured. A compensating effect will be described below. When the lens power of the first electron lens coincides with a designed value, no potential difference is present between the opposite electrodes constituting the second electron lens. Therefore, the second electron lens exhibits no effect, and a plurality of electron beams are properly converged and focused on the phosphor screen by only the first electron lens. In contrast to this, assume that electron beams are properly focused at a predetermined position in a state wherein the lens power of the first electron lens is larger than the designed value. In this case, overconvergence is caused if only the first electron lens functions. In this case, since the second electron lens functions to deflect the side electron beams in a direction to separate from the center electron beam, a plurality of electron beams are properly focused on the phosphor screen. In contrast to this, if electron beams are properly focused at a predetermined position in a state wherein the lens power of the first electron lens is smaller than the designed value, a plurality of electron beams are subjected to underconvergence. At this time, the second electron lens deflects the side electron beams in a direction to approach the center electron beam so as to properly converge the electron beams on the phosphor screen.

DETAILED DESCRIPTION OF THE PREFERRED EMBODIMENTS

A color cathode ray tube according to an embodiment of the present invention will be described below with reference to the accompanying drawings.

Figure 1:
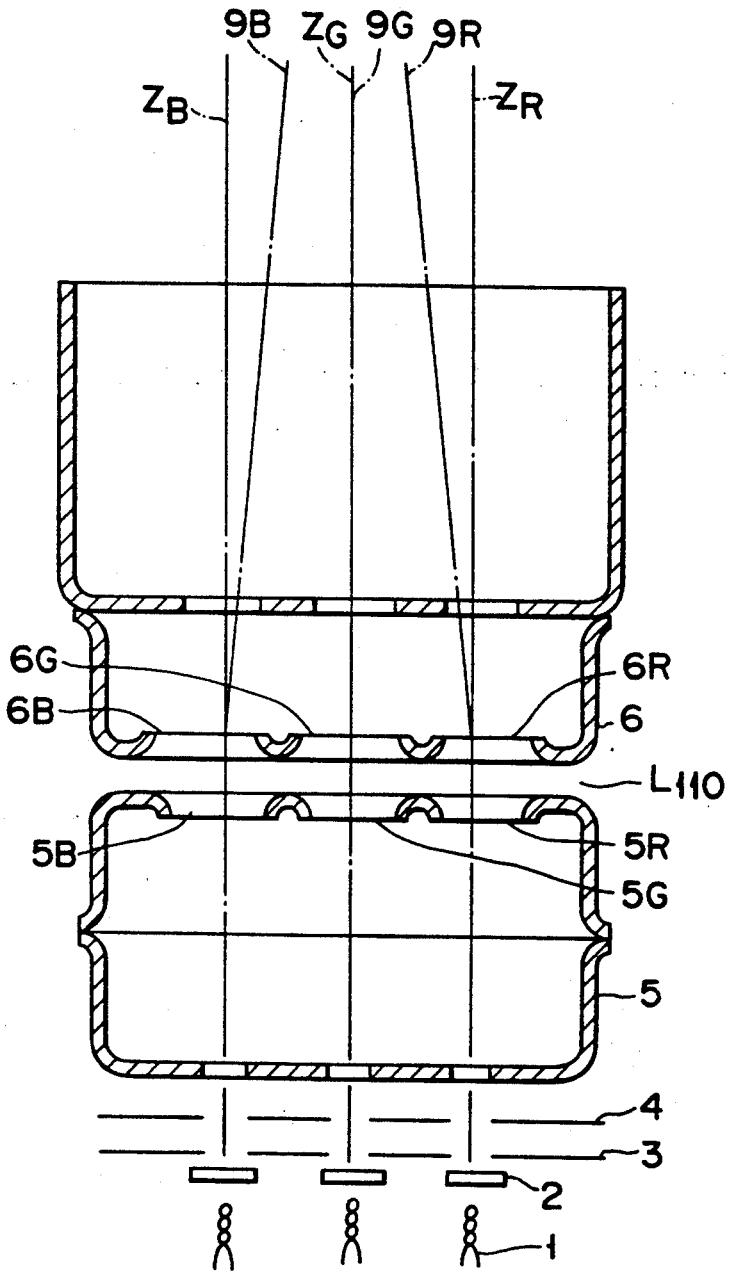
FIG. 1 (PRIOR ART)
FIGS. 1 and 2 are sectional views taken along the in-line planes of conventional in-line type electron gun assemblies.
Figure 2:
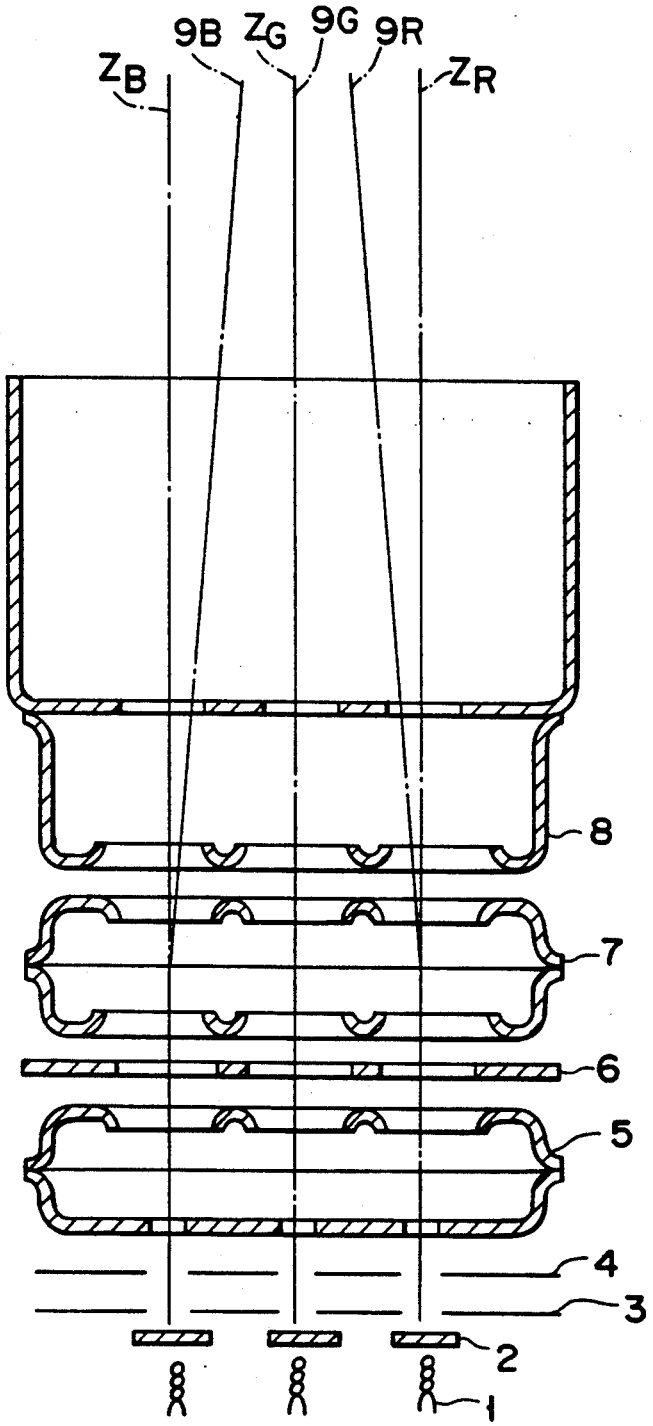
FIG. 2 (PRIOR ART)
Figure 3:
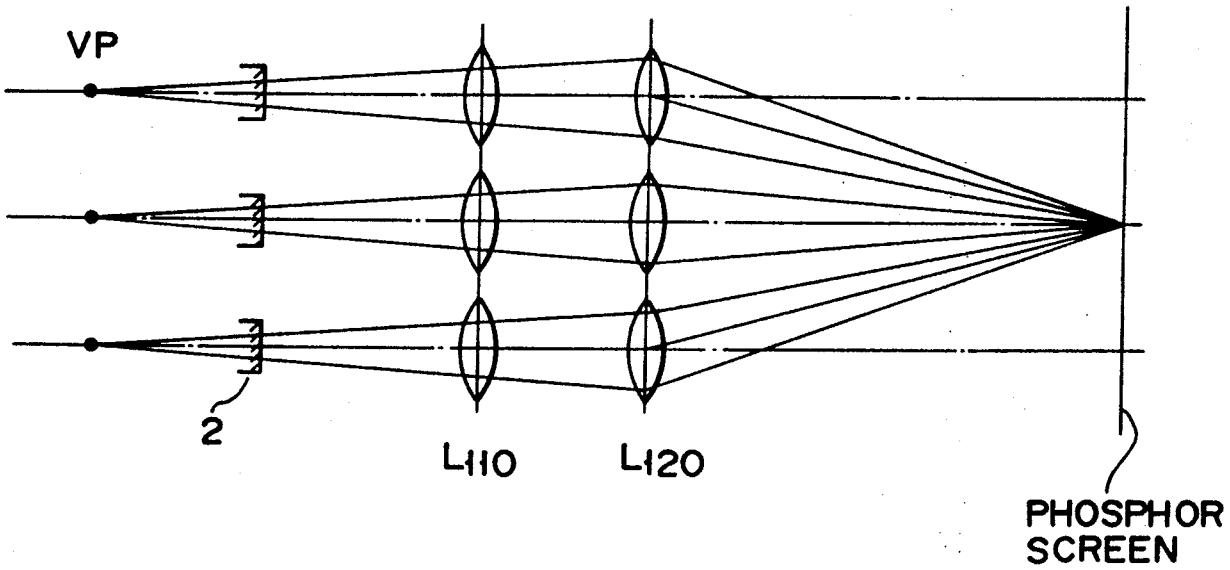
FIG. 3 (PRIOR ART)
FIG. 3 is a view showing a positional relationship between an electron lens system and object points in a conventional electron gun assembly.
Figure 4:
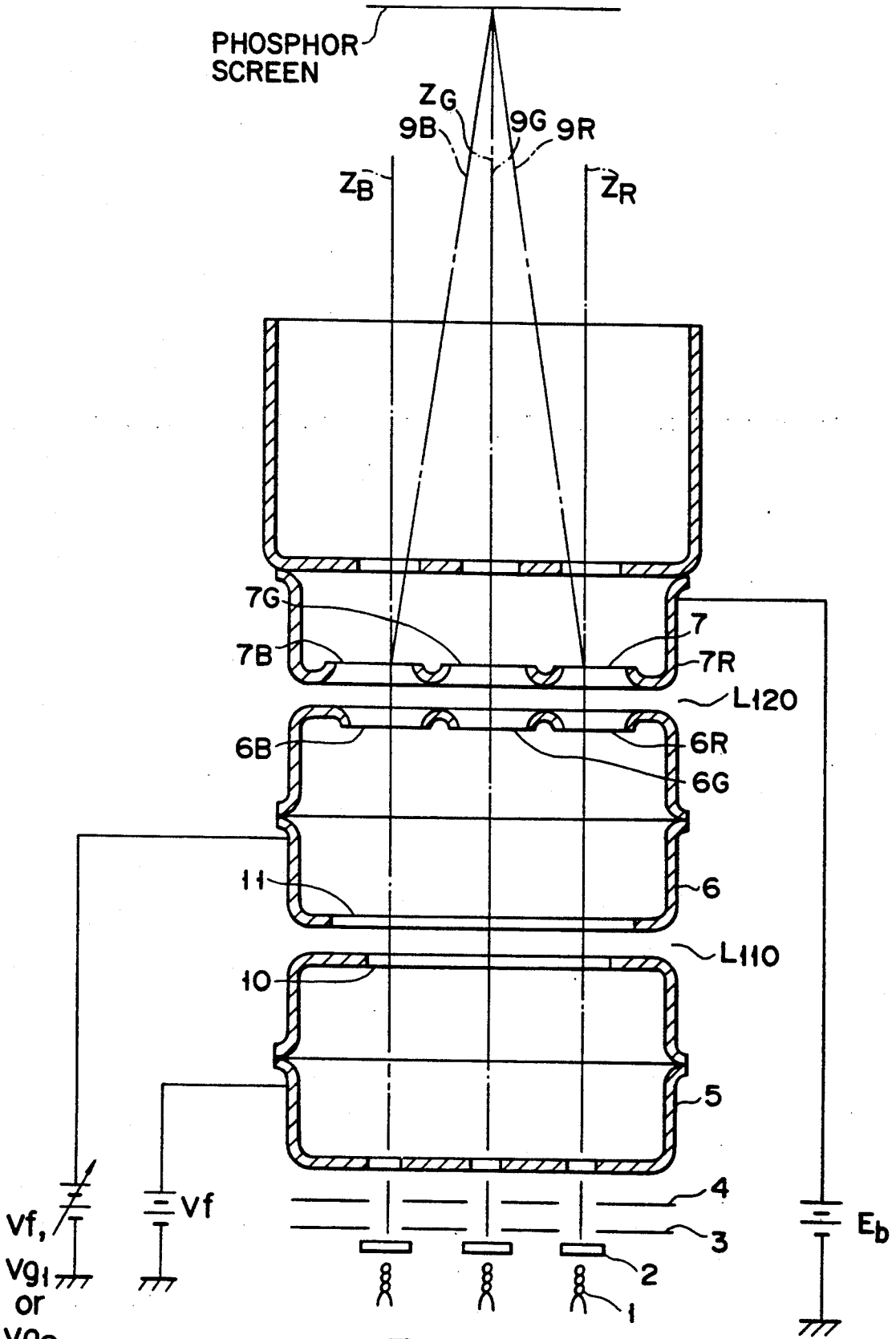
FIG. 4 is a sectional view taken along the in-line plane of an in-line type electron gun assembly according to an embodiment of the present invention.

FIG. 4 is a sectional view taken along an X-Z plane (horizontal plane) of an electron gun assembly, incorporated in a color cathode ray tube and set in an in-line arrangement, for emitting three electron beams, according to an embodiment of the present invention. In this case, the horizontal direction means an in-line direction, and the vertical direction means a direction perpendicular to the in-line direction.

Figure 5A:
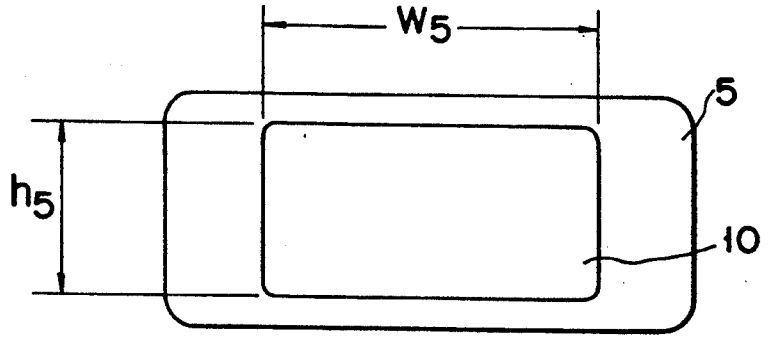
FIGS. 5A to 5C are plan views showing the shapes of apertures formed in electrodes for forming a common electron lens shown FIG. 4.
Figure 5B:
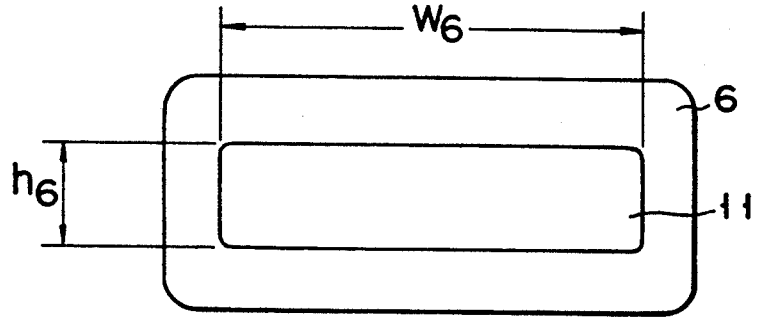
Figure 5C:
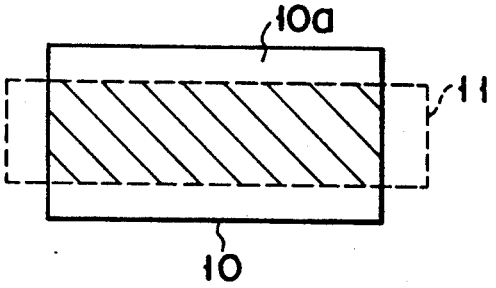

The electron gun assembly comprises cathodes 2 respectively incorporating heaters 1, and the following grids, each of which is integrally formed: a first grid 3, a second grid 4, a third grid 5, a forth grid 6, and a fifth grid 7. A common electron lenses are formed between the third grid 5 and the forth grid 6. FIGS. 5A 5B and 5C show the shapes of apertures, of electrodes which form the common electron lens, viewed from the tube axis direction. FIG. 5A shows a substantially rectangular aperture 10 formed in a bottom, of the third grid 5 as a first electrode, on the phosphor screen side. FIG. 5B shows a substantially rectangular aperture 11 formed on a bottom, of the forth grid 6 as a second electrode, on the cathode side. As shown in FIG. 5A, providing that the in-line direction is a lateral direction, and a direction perpendicular to the in-line direction is a longitudinal direction, the substantially rectangular aperture 10 having a height h5 and a width w5, which is common to three electron beams 9B, 9G, and 9R, is formed in a bottom, of the third grid 5, on the phosphor side. As shown in FIG. 5B, the substantially rectangular aperture 11 having a height h6 and a width w6, which is common to the three electron beams 9B, 9G, and 9R, is formed in a bottom, of the forth grid 6, on the cathode side. The heights and widths of the apertures have the following relationships: $h6<h5$ and $w6>w5$. FIG. 5C is a plan view showing a state wherein the two apertures 10 and 11 overlap each other in the tube axis direction. Referring to FIG. 5C, a solid line indicates the substantially rectangular aperture 10 formed in a bottom, of the third grid 5, on the phosphor screen side; a dotted line, the substantially perpendicular aperture 11 formed in a bottom, of the forth grid 6, on the cathode side; and a hatched portion, a common aperture portion where the apertures 10 and 11 overlap. Since the common aperture portion corresponds to a portion common to the aperture areas of the two apertures in the tube axis direction, the aperture size of the overlapping common aperture portion in this embodiment has a height h6 and a width w5. As shown in FIG. 5C, the substantially rectangular aperture 10, of the third grid 5 as the first electrode, on the phosphor screen side has an extended portion 10*a* extending to the overlapping common aperture in a direction perpendicular to the in-line direction. As long as the width w5 of the extended portion 10*a* in the in-line direction is smaller than the width w6, of the forth grid 6 as the second electrode, on the cathode side in the in-line direction, the extended portion 10*a* may be formed to partially extend in the widthwise direction or to entirely extend along the widthwise direction as in this embodiment.

Individual electron lenses L120 as a focusing lens are formed between the forth grid 6 having apertures 6G, 6B, and 6R and the fifth grid 7 having apertures 7G, 7B, and 7G. The apertures 6G, 6B, and 6R are formed in a bottom of a cylindrical member, integrally formed by a mechanical means to constitute the forth grid 6, in such a manner that the centers of the apertures respectively coincide with a gun axis ZG of the center electron gun and with gun axes ZB and BR of the side electron guns. The apertures 7G, 7B, and 7R are formed in the bottom of a cylindrical member, integrally formed by a mechanical means to constitute the fifth grid 7, in such a manner that the center of the aperture 7G coincides with the gun axis ZG, while the centers of the apertures 7B and 7R are eccentric from the gun axes ZB and ZR.

A high voltage Eb as an anode acceleration voltage is applied to the fifth grid 7, whereas an intermediate voltage Vf as a focusing voltage, designed to be about 25 to 35% of the anode acceleration voltage, is applied to the forth grid 6. In such a combination of the forth and fifth grids 6 and 7, since the centers of the apertures 6G and 7G coincide with the gun axis ZG, the center electron beam 9G propagates straight ahead to the phosphor screen. In contrast to this, since the side electron beams 9B and 9R pass through asymmetrical electric fields, these beams are bent toward the center electron beam 9G. As a result, the three electron beams 9B, 9G, and 9R are caused to converge on the phosphor screen. In this case, if a voltage having substantially the same potential as that of the voltage applied to the forth grid 6 is applied to the third grid 5 from a power source different from that for the forth grid 6, since no potential difference is present between the forth and third grids 6 and 5, no electron lens is formed. If, however, a fluctuating intermediate voltage Vf' fluctuating from the value designed as a focusing voltage is applied to the forth grid 6, a potential difference is generated between the third and forth grids 5 and 6. With this potential difference and the aperture shape shown in FIG. 5C, the asymmetrical lens as the common electron lens L110 for correcting convergence is formed, thus causing the three electron beams to accurately converge on the screen.

Figure 6A:
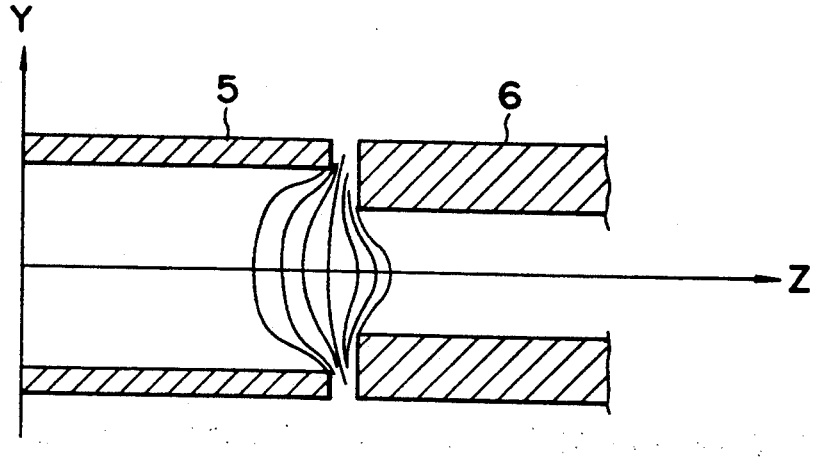
FIGS. 6A and 6B are views showing potential distributions around the electrodes which form the common electron lens shown in FIG. 4.
Figure 6B:
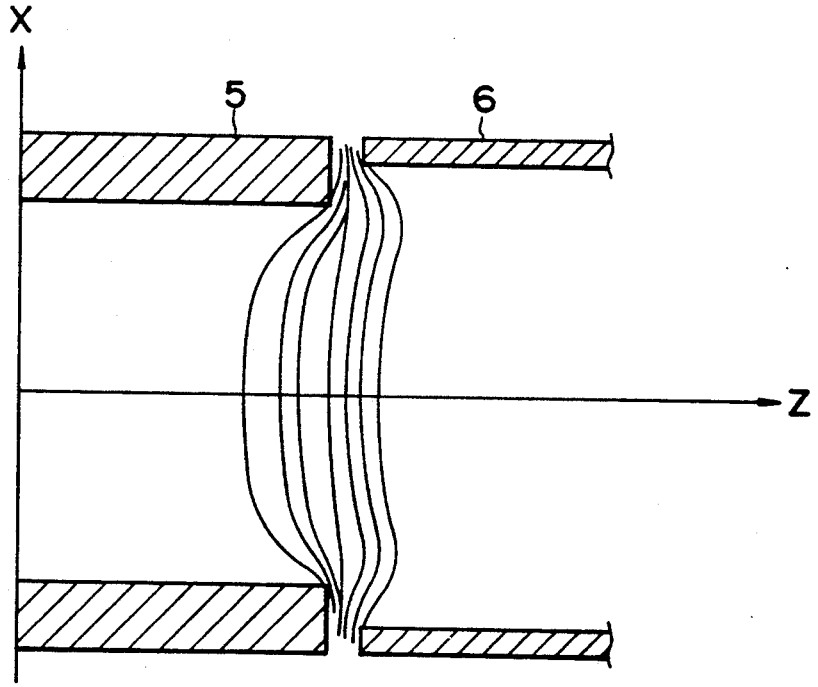
Figure 7A:
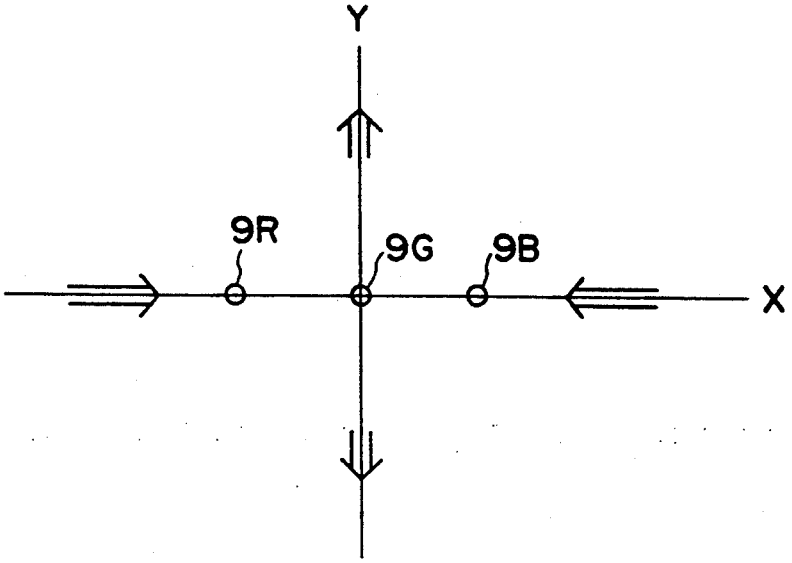
FIGS. 7A and 7B are plan views for explaining a focusing correction lens effect on an X-Y plane in the electron gun assembly shown in FIG. 4.
Figure 7B:
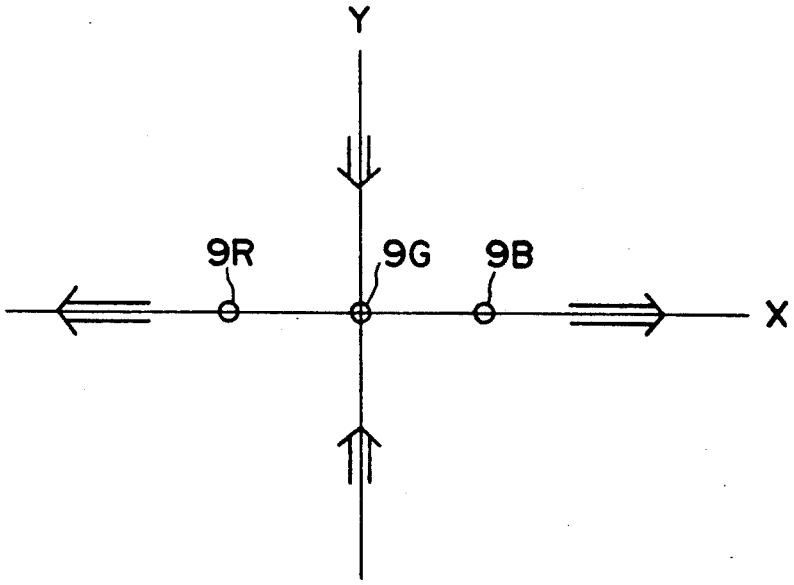
Figure 8:
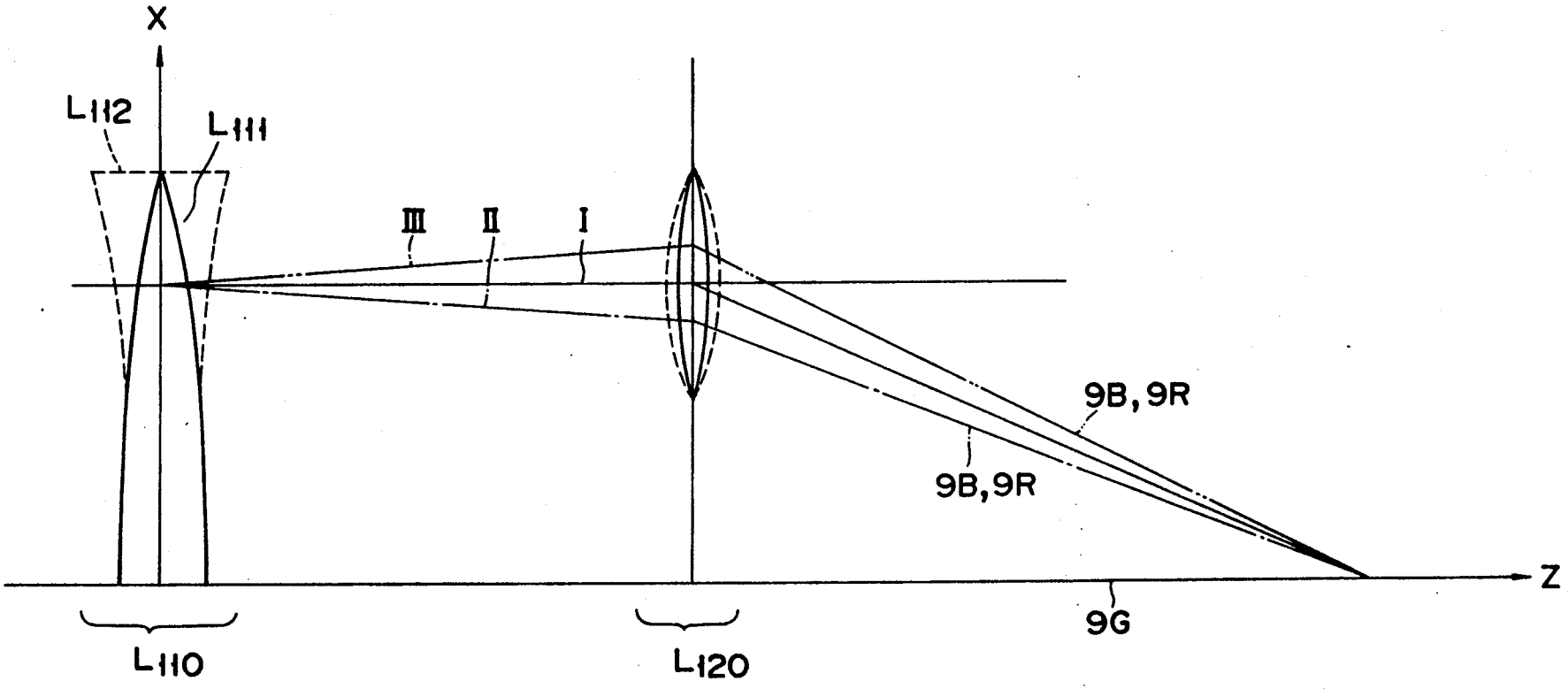
FIG. 8 is a plan view for explaining a focusing correction lens effect on an X-Z plane in the electron gun assembly shown in FIG. 4.

This asymmetrical lens as the common electron lens is a tetrode lens. An effect of the tetrode lens will be described below with reference to FIGS. 6A and 6B showing potential distributions, FIGS. 7A and 7B for explaining a lens effect on an X-Y plane, and FIG. 8 showing a lens effect on an X-Z plane and the paths of electron beams. In these drawings, X and Y axes respectively represent the in-line direction and a direction perpendicular thereto, and a Z direction indicates the axis of the center electron beam. As shown in FIGS. 6A and 6B, a lens which is asymmetrical about an axis is formed between the third and forth grids 5 and 6. As shown in FIG. 6A, since an electron beam passes through substantially the center of the lens, only a small lens effect acts on the electron beam in the Y-axis direction. As shown in FIG. 6B, a weak lens, represented by equipotential lines, is formed in the X-axis direction, and a side electron beam receives a proper deflection effect. Referring to FIG. 8, a path I of electron beams is obtained when the same potential as that of the intermediate voltage Vf designed as a focusing voltage is applied to the forth grid 6 so as not to generate a potential difference between the forth and third grids 6 and 5, and the lens powers of the individual electron lenses are maintained at a predetermined value. Therefore, the common electron lens has no effect on the electron beams. In this case, the side electron beams 9B and 9R are focused onto the phosphor screen by the focusing lens L120 as the individual electron lens and are simultaneously converged thereon. If the focusing voltage applied to the forth grid 6 is changed to a voltage Vg1 higher than the designed voltage Vf to cause the lens power of the individual electron lens to fluctuate, since the voltage applied to the third grid 5 is fixed to the focusing voltage Vf, the tetrode lens L110 as the common electron lens serves as an electron lens L111 exhibiting a focusing property in the in-line direction, i.e., the horizontal direction (X-axis direction), as shown in FIG. 8. As a result, the side electron beams 9B and 9R are deflected toward the center electron beam 9G, as shown in FIG. 7A. At the same time, the electron lens L111 serves as a divergent lens in a direction perpendicular to the in-line direction but has no influences on the focusing effect on the three electron beams. In this case, since the convergence of the focusing lens L120 as the individual electron lens is lower than a designed value, the overall convergence becomes substantially the same as the designed value. As a result, the side electron beams 9B and 9R propagate along a path II shown in FIG. 8. In contrast to this, if the focusing voltage applied to the forth grid 6 becomes an intermediate voltage Vg2 lower than the designed voltage Vf, and the lens power of the individual electron lens fluctuates, the tetrode lens as the common electron lens serves as the electron lens L112 exhibiting divergence in the in-line direction (X-axis direction). As a result, the side electron beams 9B and 9R are deflected in a direction to separate from the center electron beam 9G. At the same time, the electron lens L112 serves as a focusing lens in a direction perpendicular to the in-line direction but has no influences on a focusing effect on the three electron beams. In this case, in contrast to the above-described case, the convergence of the focusing lens L120 is increased, and hence the overall convergence becomes substantially the same as the designed value. Therefore, the side electron beams propagate along a path III shown in FIG. 8.

Figure 9:
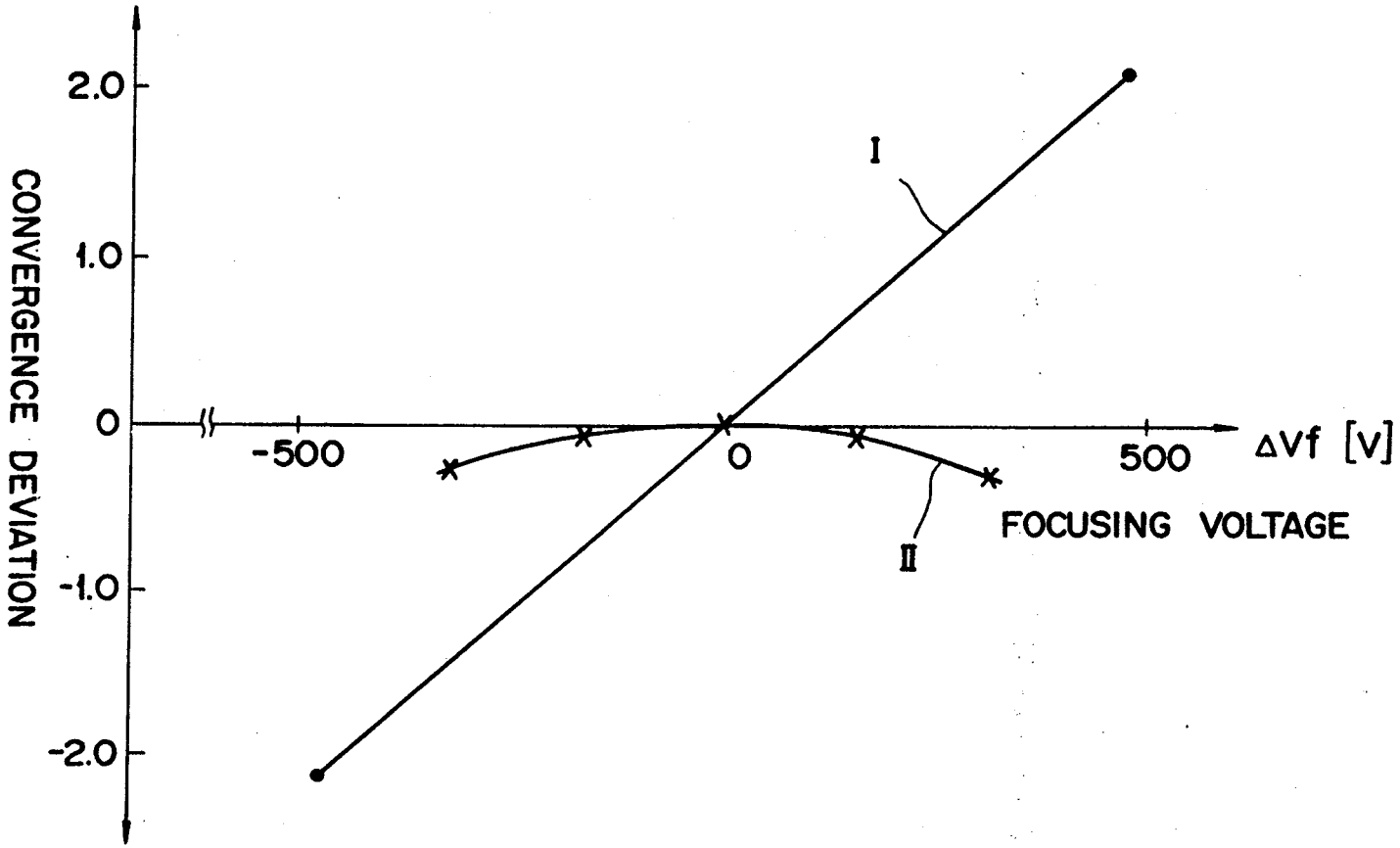
FIG. 9 is a graph showing relationships between focusing voltages and convergence deviations in the electron gun assembly shown in FIG. 4 and in a conventional electron gun assembly.

FIG. 9 shows relationship betweens deviations ΔVf from a designed focusing voltage and convergence deviations. Referring to FIG. 9, a curve II represents a relationship in the above embodiment of the present invention, and a curve I represents a relationship in a conventional in-line type electron gun. It is apparent from FIG. 9 that in the above-described embodiment, even if the focusing voltage applied to the individual electron lens, i.e., an in-line type electron gun of a conventional color cathode lens, is changed, the convergence of the three electron beams is not substantially changed. Furthermore, in the present invention, since the common electron lens having the focusing correction effect is constituted by the tetrode lens, although the focusing or convergent electron lens is formed in the vertical direction, since the formed lens is a large lens which allows the three electron beams to pass through, only a very small lens effect acts on each of the three electron beams in the vertical direction. Therefore, astigmatism of each electron beam is negligibly small.

Figure 10A:
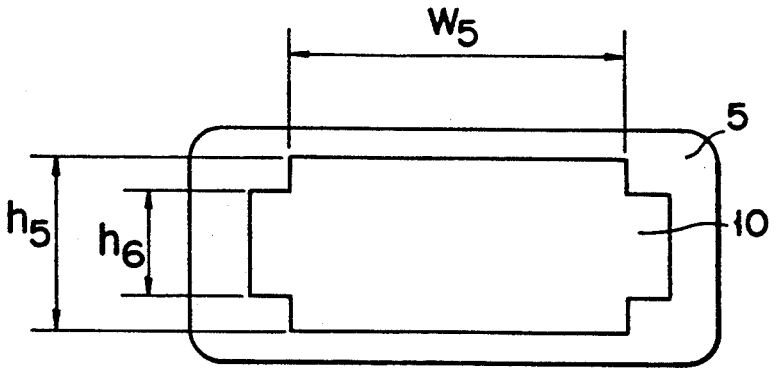
FIGS. 10A, 10B, and 10C are plan views showing electrodes for forming a common electron lens according to a modification of the electron gun assembly of the present invention.
Figure 10B:
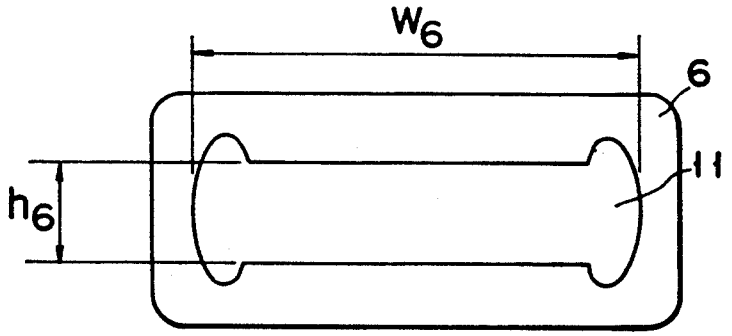
Figure 10C:
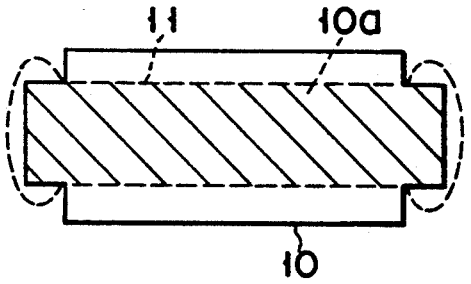

FIGS. 10A, 10B, and 10C show a modification of the first electron lens of the in-line type electron gun which is applied to the color cathode ray tube of the present invention. FIG. 10A shows a substantially rectangular aperture 10 formed in a bottom, of a third grid 5 as a first electrode, on the phosphor screen side. FIG. 10B shows a substantially rectangular aperture 11 formed in a bottom, of a forth grid 6 as a second electrode, on the cathode side. As shown in FIG. 10A, the length of the aperture of the third grid 5 in the in-line direction may be set to be longer than that of a region near a portion through which three electron beams substantially pass. FIG. 10C is a plan view showing a state wherein the two apertures 10 and 11 overlap. Referring to FIG. 10C, a solid line indicates the substantially rectangular aperture 10 formed on the bottom, of the third grid 5, on the phosphor screen side, whereas a dotted line indicates the substantially rectangular aperture 11 formed in the bottom, of the forth grid 6, on the cathode side. As is apparent from FIG. 10C, the first electrode has a portion 10*a* partially extending from an overlapping common aperture 10*a* in a direction perpendicular to the in-line direction. An aperture length W5 of the extended portion 10*a* in the in-line direction is set to be smaller than an aperture length W6 of the first electrode in the in-line direction, thus forming a tetrode lens.

Figure 11A:
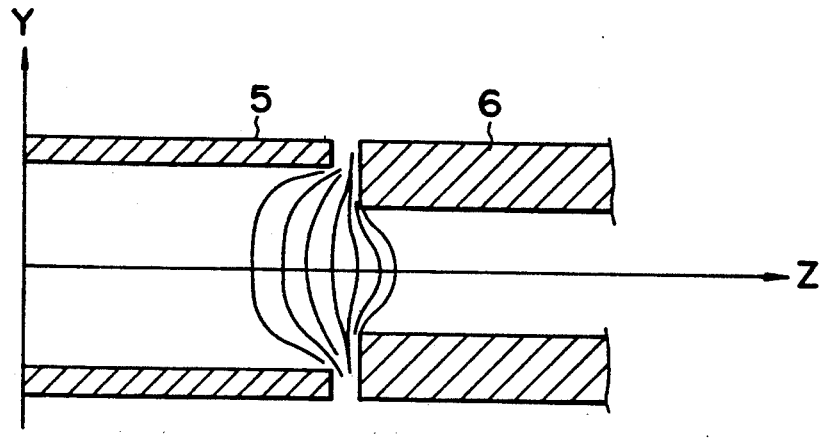
FIGS. 11A and 11B are views showing potential distributions of the common electron lens formed by the electrodes shown in FIGS. 10A and 10B.
Figure 11B:
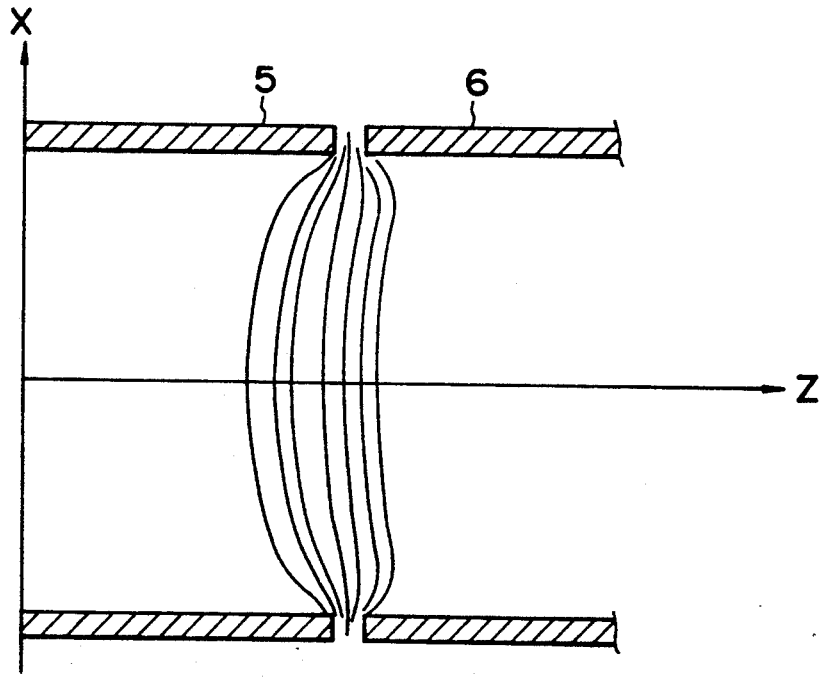

FIGS. 11A and 11B show potential distributions of the common electron lens in the electrode structure shown in FIGS. 10A and 10B. In the structure having such an aperture shape, since the aperture length of the overlapping common aperture in the in-line direction can be set to be larger than that in the electrode structure shown in FIGS. 5A and 5B. gradual equipotential lines in the in-line direction are formed, as shown in FIG. 11B, thus allowing a reduction in beam spot distortion due to deflection of side electron beams.

In the two embodiments described above, the common electron lens is described as a tetrode lens. However, the present invention is not limited to this. Any lens may be used as a common electron leans as long as it exhibits a diverging effect when the potential of a first electrode is higher than that of a second electrode in the in-line direction, and exhibits a focusing effect when the potential of the first electrode is lower than that of the second electrode. In addition, the first and second electrodes of the first electron lens may have a relationship opposite to that in the above embodiments. That is, the first and second electrodes are arranged to oppose each other on the phosphor screen side, and a variable intermediate voltage is applied to the second electrode while a fixed intermediate voltage is applied to the first electrode. Furthermore, the common electron lens may have an electrode structure obtained by combining the electrodes shown in FIGS. 5A and 5B with the electrodes shown in FIGS. 10A and 10B.

In the two embodiments described above, each overlapping common aperture is elongated in the in-line direction. However, the aperture may be elongated in a direction perpendicular to the in-line direction. Ideally, the aperture is elongated in the direction perpendicular to the in-line direction. This is because a lens effect acting in the direction perpendicular to the in-line direction is reduced, which is preferable in terms of beam spot distortion. In practice, however, the aperture is elongated in the in-line direction due to the limitation of the diameter of a neck which houses electron guns.

Figure 12:
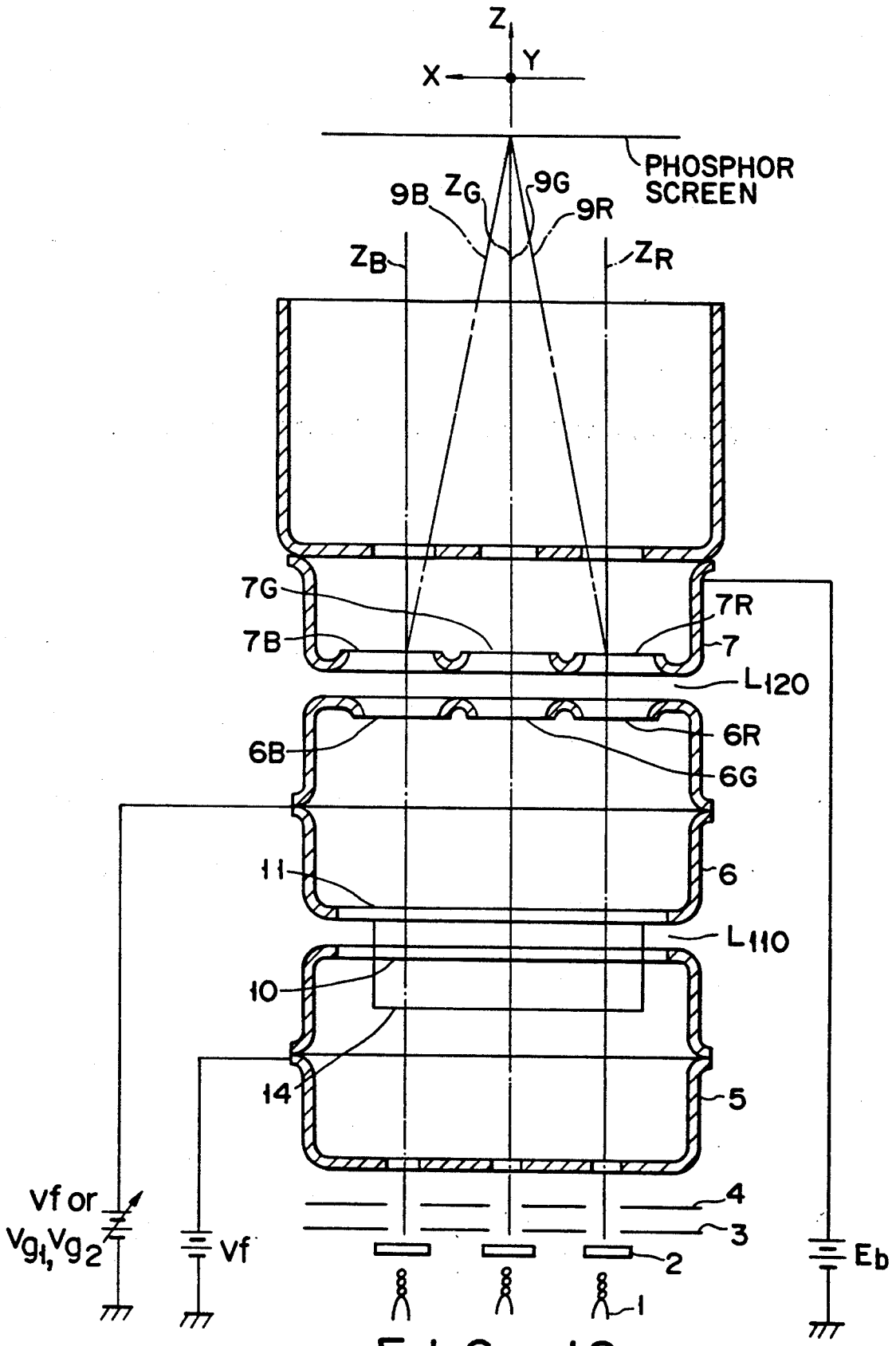
FIG. 12 is a sectional view taken along an X-Z plane (horizontal plane) of an in-line type electrode gun according to another embodiment of the present invention.
Figure 13:
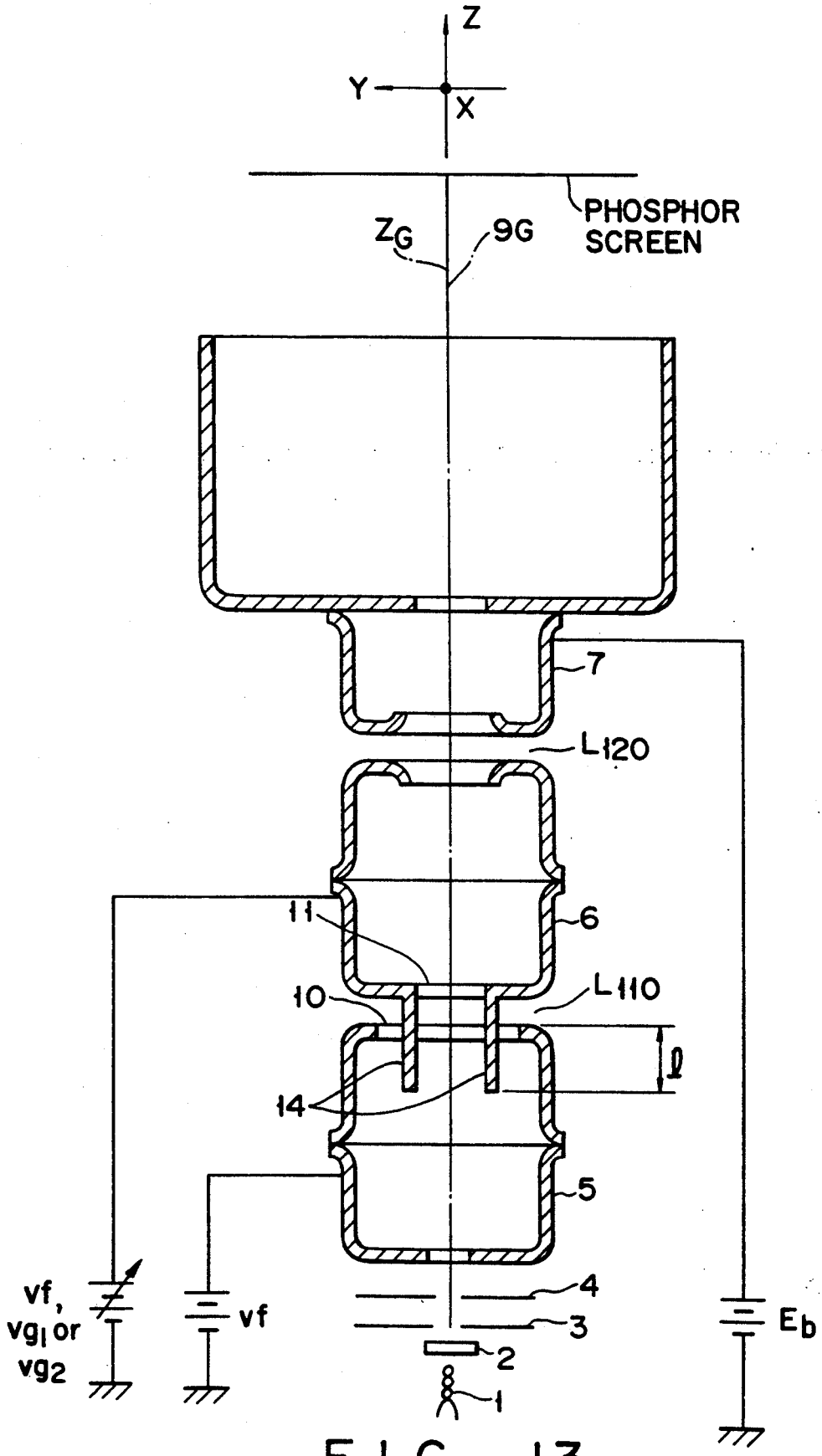
FIG. 13 is a sectional view taken along a Y-Z plane (vertical plane) of the first electron gun assembly shown in FIG. 12.
Figure 14A:
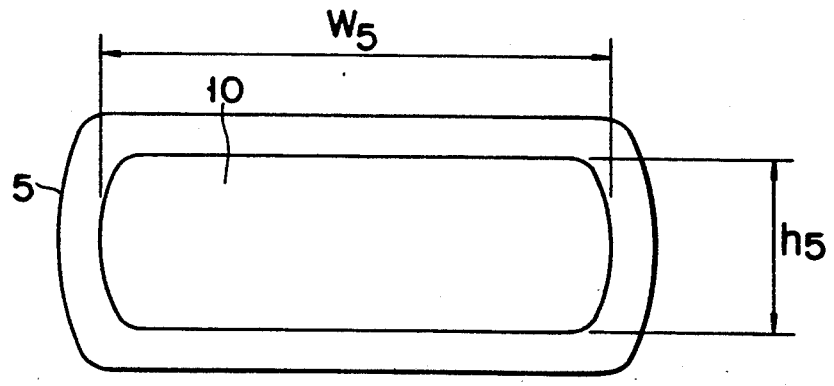
FIGS. 14A and 14B are plan views showing the shapes of apertures for forming a common electron lens shown in FIG. 12.
Figure 14B:
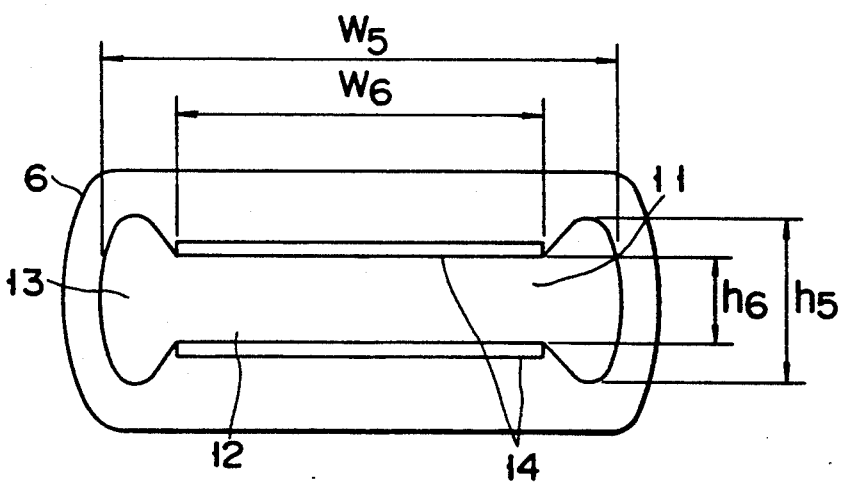

An in-line type electron gun assembly according to another embodiment of the present invention will be described below with reference to FIGS. 12 to 19. FIG. 12 is a sectional view taken along an X-Z plane (horizontal plane) of the in-line type electron gun assembly according to another embodiment of the present invention. FIG. 13 is a sectional view taken along a Y-Z plane (vertical pane) of the in-line type electron gun assembly. FIGS. 14A and 14B show aperture shapes of electrodes which constitute a common electron lens. FIG. 14A shows a common aperture 10 formed in a bottom, of a third grid 5 as a cathode-side electrode of opposite electrodes, on the phosphor screen side. FIG. 14B shows a common aperture 11 formed in a bottom, of a forth grid 6 as a phosphor-screen-side electrode of the opposite electrodes, on the cathode side.

The same reference numerals in FIGS. 12, 13, 14A, and 14B denote the same parts as in FIGS. 4, 5A, and 5B, and a description thereof will be omitted. As shown in FIG. 14A, the continuous aperture 10 having a common horizontal aperture size w5 and a vertical aperture size h5 is formed in a bottom, of the third grid 5, on the phosphor screen side, so as to allow three electron beams 9B, 9G, and 9R to pass therethrough. The aperture 11 having the horizontal aperture size w5 and elongated substantially in the horizontal direction is formed in a bottom, of the forth grid 6, on the cathode side, so as to allow the three electron beams 9B, 9G, and 9R to pass therethrough, as shown in FIG. 14B. The aperture 11 is constituted by a region 12 having a horizontal aperture size w6 and a vertical aperture size h6 and substantially serving as a beam passing region through which the three electron beams 9B, 9G, and 9R pass therethrough, and aperture end portions 13 each having the vertical aperture size h5 and continuous with the beam passing region 12 in the horizontal direction. In this case, the respective aperture sizes have the following relationships: $h6<h5$ and $w6<w5$. A pair of correction electrode members 14 are formed on side portions of the aperture extending along the horizontal direction and defining the beam passing region 12 so as to extend from the side portions toward the anode side along a horizontal plane. These correction electrode members 14 extend from the aperture 11, of the fourth grid 6 into the aperture 10 of the third grid 5 formed into parallel plates.

In the electron gun assembly having the above-described structure, the low-voltage electrode constituting the first electron lens and one of the opposite electrodes constituting the second electron lens which is located on the phosphor screen side are constituted by the same electrode, i.e., the forth grid 6. However, the present invention is not limited to this. That is the low-voltage electrode and one of the opposite electrodes which is located on the phosphor screen side may be constituted by different electrodes.

In the electron gun having the above-described arrangement, an anode acceleration voltage Eb is applied to a fifth grid 7, and a focusing voltage Vf, about 25% to 35% of the anode acceleration voltage, is applied to the forth grid 6. In this case, since the centers of the apertures 6G and 7G coincide with the gun axis ZG in the center electron gun, the center electron beam 9G propagates straight ahead to a phosphor screen (not shown). In the side electron guns, however, since asymmetrical electric fields are formed, the side electron beams 9B and 9R passing through these electric fields are bent toward the center electron beam 9G. As a result, these three electron beams 9B, 9G, and 9R are caused to converge at a predetermined position on the phosphor screen. If substantially the same voltage as that applied to the forth grid 6 is applied to the third grid 5 from a power source different from that for the forth grid 6, since no potential difference is present between the forth and third grids 6 and 5, no electron lens is formed. If, however, a focusing voltage Vg deviated from a designed value is applied to the forth grid 6 to cause the three electron beams to converge on the phosphor screen, a potential difference is generated between the third and forth grids 5 and 6. With this potential difference and the aperture shapes shown in FIGS. 14A and 14B, an asymmetrical lens as a common lens L110 having a convergence correcting effect is formed.

Figure 15:
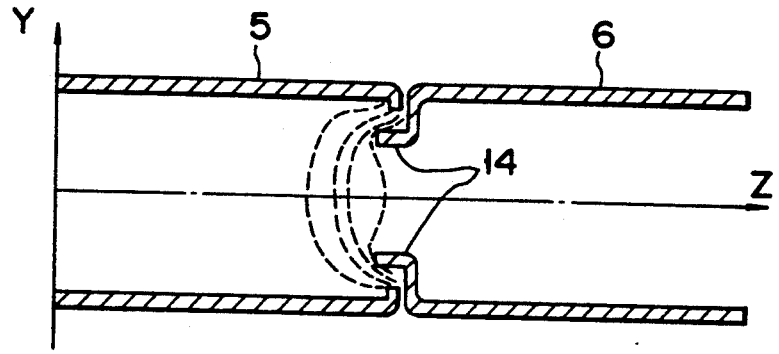
FIG. 15 is a view showing a potential distribution at the Y-Z plane (vertical plane) of the common electron lenses formed by the electrodes shown in FIG. 12.
Figure 16:
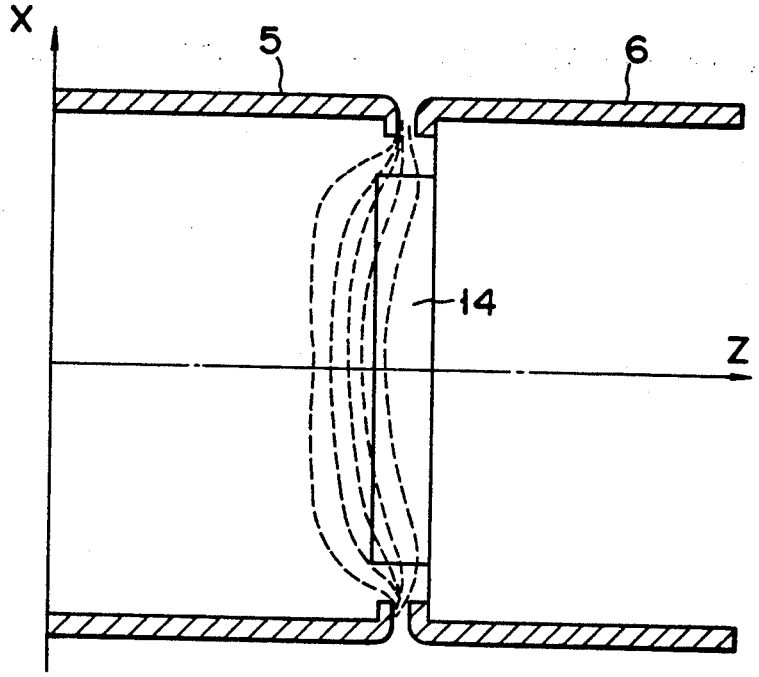
FIG. 16 is a view showing a potential distribution along the X-Z plane (horizontal plane) of the common electron lens formed by the electrodes shown in FIG. 12.
Figure 17:
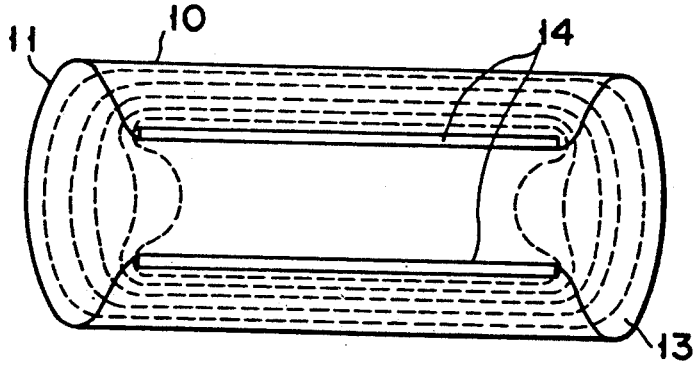
FIG. 17 is a view showing a potential distribution along an X-Y plane of the common electron lens formed by the electrodes shown in FIG. 12.

An effect of this asymmetrical lens will be described below with reference to FIGS. 15 to 17 showing potential distributions, and FIG. 8 showing a lens effect and paths of electron beams on the X-Y plane. As shown in FIGS. 15 and 16, an electron lens which is asymmetrical about an axis is formed between the third and forth grids 5 and 6. As shown in FIG. 15, with regard to the Y-axis direction, since the paths of electron beams are substantially located at the center of the lens, and the potential difference between the third and fifth grids 5 and 6 is several hundreds volts, a lens effect in the Y-axis direction is small. With regard to the X-axis direction, as shown in FIG. 16, a weak lens represented by gradual equipotential lines is elongated in the tube-axis direction (Z direction), and a proper deflecting effect acts on each side electron beam. As shown in FIG. 17, the equipotential lines partially and slightly extend through the correction electrode member 14 for the following reason. Since the aperture 11 formed in the cathode-side bottom of the grid 6 has the aperture end portions 13 each having a large vertical aperture size shown in FIG. 14B, an electric field concentrated on an end portion of the correction electrode member 14 is reduced. Therefore, each electron can be deflected in the horizontal direction with minimum beam astigmatism.

Referring to FIG. 8, which illustrates the lens model described above, if the same voltage as the designed focusing voltage Vf is applied to the forth grid 6, and no potential difference is generated between the third and forth grids 5 and 6, an electron beam propagates along the path I. In this case, since the second lens has no effect, it is not shown. At this time, the side electron beams 9B and 9R are simultaneously focused and converged on the phosphor screen by the focusing lenses L120 as the individual electron lenses. If a focusing voltage Vg1 higher than the designed voltage Vf is applied to the forth grid 6, since the voltage applied to the third grid 5 is fixed to the focusing voltage Vf, the asymmetrical lens L110 as the common electron lens serves as an electron lens L111 exhibiting a focusing property in the horizontal direction (X-axis direction). As a result, the side electron beams 9B and 9R are deflected in a direction to approach the center electron beam 9G. At this time, since the convergence of the focusing lens L120 as the individual electron lens is lower than a designed value, the overall convergence is substantially the same as the designed value. The path II in FIG. 8 corresponds to this state. If the focusing voltage applied to the forth grid 6 is a voltage Vg2 lower than the designed voltage Vf, the asymmetrical lens L110 as the common electron lens serves as an electron lens L112 exhibiting divergence in the horizontal direction (X-axis direction), contrary to the above-described case. As a result, the side electron beams 9B and 9R are defected in a direction to separate from the center electron beam 9G. Since the convergence of the focusing lens L120 is increased, contrary to the above case, the overall convergence becomes substantially the same as the designed value. The path III in FIG. 8 corresponds to this state.

Figure 18:
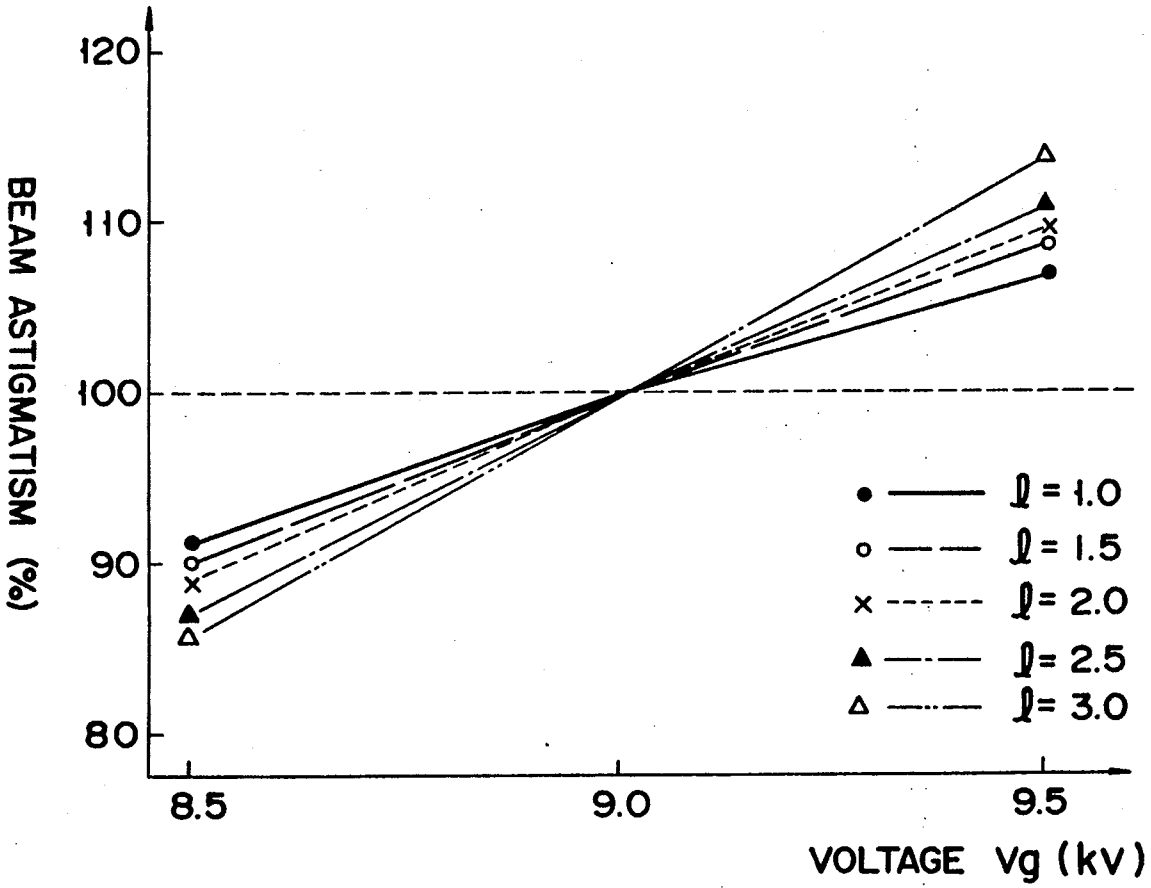
FIG. 18 is a graph showing relationships between focusing voltages and beam astigmatism in the electron gun assembly shown in FIG. 12.

The astigmatism and deflection angle of an electron beam are determined depending on a length l of a portion, of the correction electrode member 14, extending inside the third grid 5. FIG. 18 shows a relationship between the astigmatism of a side electron beam and the length l of the portion where the correction electrode member 14 overlaps the third grid 5. Conditions for the experiment in FIG. 18 are: the pitch of three electron beams, 4.92 mm; the horizontal aperture size of the substantially beam passing region 12, 15.0 mm; the vertical aperture size, 4.5 mm; the horizontal aperture size, of the aperture of the forth grid 6, including a large part of the vertical aperture size, 20.0 mm; the voltage applied to the third grid 5, a fixed voltage of 9.0 kV; and the voltage Vg applied to the forth grid 6, a variable voltage of 8.5 kV to 9.5 kV. Beam astigmatism is evaluated by measuring a horizontal size LH and a vertical size LV of a beam emerging from the second electron lens, and calculating beam astigmatism $k=(LV/LH)\times 100$ %. When $k>100$, a vertically elongated beam spot is obtained. When $k<100$, a horizontally elongated beam spot is obtained. It is apparent from FIG. 18 that in order to obtain a beam astigmatism k of 95% to 105% when the voltage Vg applied to the forth grid 6 is 8.8 kV to 9.2 kV, the length l is set to be 1.0 to 2.5 mm.

Figure 19:
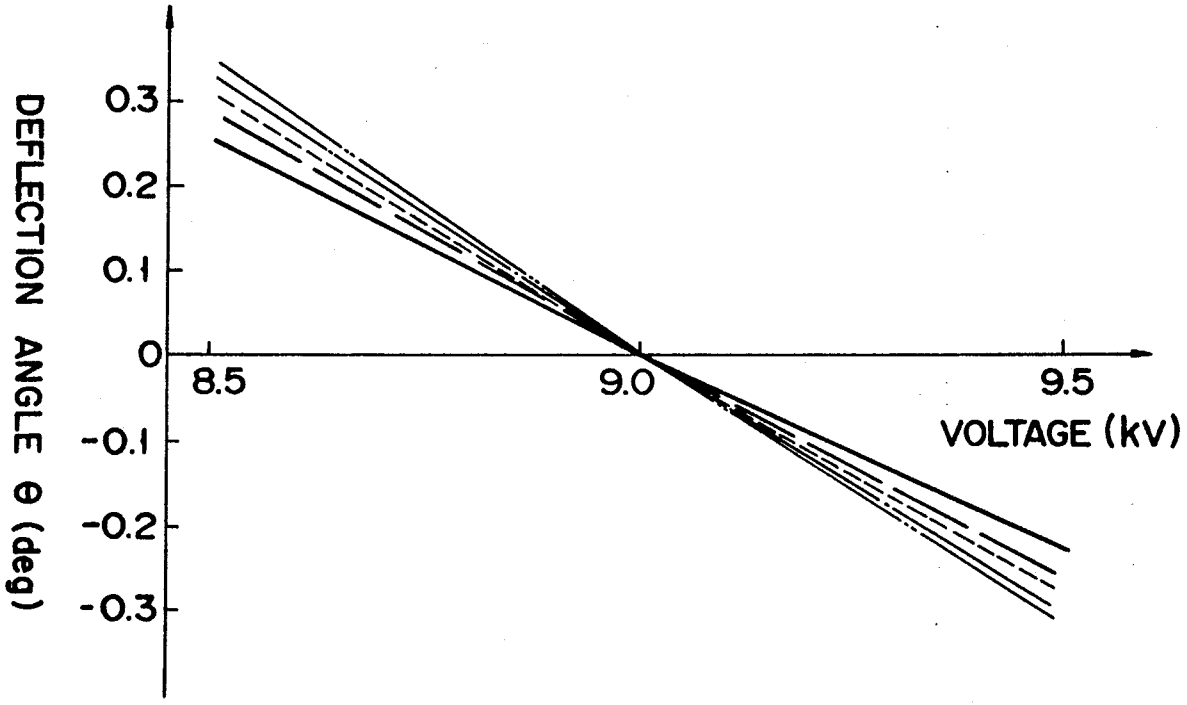
FIG. 19 is a graph showing relationships between focusing voltages and the defection angles of side electron beams in the electron gun assembly shown in FIG. 12.

FIG. 19 shows a relationship between the deflection angle of a side electron beam and the length of the portion where the correction electrode member 14 overlaps the third grid 5. Referring to FIG. 19, a deflection angle $\theta$ takes a positive value when a side electron beam is deflected in a direction to separate from a center electron beam. It is apparent from FIGS. 18 and 19 that desired characteristics can be obtained by properly setting the length l of the, correction electrode member 14.

In the electron gun assemblies shown in FIGS. 12 and 13, the characteristics shown in FIG. 9 can be obtained in the same manner as in the electron gun assembly shown in FIG. 4. With regard to the description of FIG. 9, refer to the associated portions already described above.

Note that U.S. Pat. No. 4,851,741 discloses an electron gun assembly having a structure similar to that of the electron gun assembly of the present invention. In this electron gun assembly, the power of an asymmetrical lens constituted by plate-like correction electrodes formed to vertically sandwich the respective beam apertures formed in bottoms, of electrodes constituting a main electron lens, on the cathode side, and opposite electrodes having a common aperture enclosing these plate-like correction electrodes is changed by applying a dynamic voltage to the plate-like correction electrodes. This invention, however, is associated with dynamic focusing. In this invention, an electron beam is subjected to astigmatism in front of the main electron lens. In contrast to this, according to the present invention, convergence correction is performed without causing astigmatism of each electron beam. Therefore, it is apparent that the present invention is different from the invention disclosed in U.S. Pat. No. 4,851,741.

The voltage fixed as the focusing voltage applied to one of the electrodes constituting the second electron lens having the convergence compensating effect may be applied by dividing an anode voltage at a predetermined ratio by incorporating a resistor in the tube.

As has been described above, according to the present invention, there is provided a very practical, high-resolution color cathode ray tube wherein even if a focusing voltage is deviated from a designed value, the convergence of the three electron beams at a predetermined position on the phosphor screen is kept constant, and no change in beam spot size is caused by compensation for convergence.

In the above embodiments, a BPF type electron lens is used as the main electron lens. However, it is apparent that the present invention can be applied to a unipotential type electron lens system (Uni Potential Focus: UPF) electron gun assembly and other composite type electron gun assemblies. In addition, the above description is associated with only the individual electron lens as the focusing lens which is eccentric with respect to side electron beams. However, the electrode structure of the individual electron lenses is not limited to this and a lens system of the individual electron lens may be formed as a single electron lens. Furthermore, the shape of the aperture, which is formed in the phosphor-screen-side electrode of the opposite electrodes constituting the common electron lens, is substantially elongated in the horizontal direction, and has a large vertical aperture size, is not limited to these in the above-described embodiments and may be properly selected.

Moreover, the voltage fixed as the focusing voltage applied to one of the electrodes constituting the second electron lens having the convergence compensating effect may be applied by dividing an anode voltage at a predetermined ratio by incorporating a resistor in the tube.

What is claimed is:

1. An in-line electron gun for a color cathode ray tube, comprising:

generating means for generating, accelerating and controlling first, second, and third electron beams in an in-line arrangement;

emitting means for emitting light rays when the first, second, and third electron beams are landed thereon; and first, second, and third electrodes arranged between the emitting means and the generating means, the first electrode having a first single aperture for allowing the first, second, and third electron beams to pass therethrough, the first single aperture having a first width along the in-line arrangement, the second electrode having a first single aperture arranged to oppose the first single aperture of the first electrode, for allowing the first, second, and third electron beams to pass therethrough, and a set of three apertures, each for allowing one of the first, second, and third electron beams to pass therethrough, respectively, the first single aperture of the second electrode having a first width larger than the first width of the first single aperture of the first electrode along the in-line arrangement, and the third electrode having a set of three apertures, each arranged to oppose a correspondence aperture of the set of the second electrode each for allowing one of the first, second, and third electron beams to pass therethrough, respectively.

2. An in-line electron gun for a color cathode ray tube according to claim 1, wherein the first single aperture of the first electrode has a first height along a direction to cross the in-line arrangement, and the first single aperture of the second electrode has a first height smaller than the first height of the first single aperture of the first electrode along the direction to cross the in-line arrangement.

3. An in-line electron gun for a color cathode ray tube according to claim 1, wherein the first single aperture of the first electrode is formed into a rectangular shape extending along the in-line arrangement.

4. An in-line electron gun for a color cathode ray tube according to claim 1, wherein the first single aperture of the second electrode is formed into a rectangular shape extending along the in-line arrangement.

5. An in-line electron gun for a color cathode ray tube according to claim 1, wherein the first single aperture of the first electrode include a rectangular portion extending along the in-line arrangement and extended portions on both sides thereof.

6. An in-line electron gun for a color cathode ray tube according to claim 9, wherein the first single aperture of the second electrode includes a rectangular portion extending along the in-line arrangement and extended portion on both sides thereof.

7. An in-line electron gun for a color cathode ray tube, comprising:

generating means for generating, accelerating, and controlling first, second, and third electron beams in an in-line arrangement;

emitting means for emitting light rays when the first, second, and third electron beams are landed thereon;

first second, and third electrodes arranged between the emitting means and the generating means, the first electrode having a first single aperture for allowing the first, second, and third electron beams to pass therethrough, the first single aperture having a first width along the in-line arrangement and including a rectangular portion extending along the in-line arrangement and extended portions on both sides thereof, the second electrode having a first single aperture arranged to oppose the first single aperture of the first electrode, for allowing the first, second, and third electron beams to pass therethrough, and a set of three apertures, each for allowing one of the first, second, and third electron beams to pass therethrough, respectively, the first single aperture of the second electrode having a first width substantially same as the first width of the first single aperture of the first electrode along the in-line arrangement and including a rectangular portion extending along the in-line arrangement and extended portions on both sides thereof, and the third electrode having a set of three apertures, each arranged to oppose a corresponding aperture of the set of the second electrode, each for allowing the first, second, and third electron beams to pass therethrough, respectively; and a pair of plate members each extending from the second electrode into the first aperture of the first electrode, the plate members each having a first width smaller than the first width of the first single aperture of the first electrode, a distance between the plate members being smaller than the first width of the first single aperture of the first electrode.

8. An in-line electron gun for a color cathode ray tube according to claim 7, wherein the first single aperture of the first electrode has a first height along a direction to cross the in-line arrangement, and the first single aperture of the second electrode has a first height smaller than the first height of the first single aperture of the first electrode along the direction to cross the in-line arrangement.

9. An in-line electron gun for a color cathode ray tube according to claim 7, wherein the first single aperture of the first electrode is a rectangular shape extending along the in-line arrangement.

10. An in-line electron gun for a color cathode ray tube according claim 7, wherein the first single aperture of the second electrode is a rectangular shape extending along the in-line arrangement.

* * * * *